United States Patent [19]

Brisebarre et al.

[11] 4,126,147

[45] Nov. 21, 1978

[54] METHOD OF GIVING CHANGE AUTOMATICALLY AND A COIN DISPENSER

[75] Inventors: Marcel Brisebarre, Thoiry, France; Pierre Repetti, Prilly, Switzerland

[73] Assignee: Systems and Technics S.A., Gland, Switzerland

[21] Appl. No.: 771,370

[22] Filed: Feb. 23, 1977

[30] Foreign Application Priority Data

Mar. 1, 1976 [CH] Switzerland ..... 2490/76

[51] Int. Cl.[2] ..... G07D 1/06

[52] U.S. Cl. ..... 133/5 R; 133/2

[58] Field of Search ..... 133/1 R, 2, 4 R, 5 R; 194/DIG. 26

[56] References Cited

U.S. PATENT DOCUMENTS

| | | | |
|---|---|---|---|
| 2,975,789 | 3/1961 | Schmidt | 133/2 |
| 3,590,833 | 7/1971 | Walton | 133/2 |
| 3,682,183 | 8/1972 | Morrow et al. | 133/1 R |
| 3,756,256 | 9/1973 | Hatanaka et al. | 194/DIG. 26 |
| 3,958,583 | 5/1976 | Shigemori et al. | 133/4 R |
| 3,963,035 | 6/1976 | Levasseur | 133/2 |

*Primary Examiner*—Joseph J. Rolla

*Attorney, Agent, or Firm*—Young & Thompson

[57] ABSTRACT

A coin dispenser sequentially dispenses coins of different denominations, starting with the highest and dispensing the maximum number possible in each denomination. A plurality of stacks of coins are arranged in side-by-side relationship with a continuously rotating cylinder below them common to all the stacks. A plurality of pegs are radially slidable on and relative to the cylinder and are arranged in helical fashion, one peg per stack. Cam and ratchet mechanism is provided for selectively advancing the peg associated with the denomination of coin to be dispensed, when that peg is below its associated stack, the peg being raised during as many revolutions of the cylinder as are necessary to dispense the required number of coins of that denomination.

6 Claims, 10 Drawing Figures

METHOD OF GIVING CHANGE AUTOMATICALLY AND A COIN DISPENSER

The invention relates to an apparatus for dispensing coins, and more particularly to an apparatus which automatically returns a sum registered, or the difference between that sum and a given larger value, in coins.

Existing machines of this type are designed to have a calculator determining which coins have to be dispensed, according to the sum to be returned; once this selection has been made, they return all the coins selected simultaneously.

The main disadvantages of such arrangements are as follows:

(a) It is necessary to provide a selecting and ejecting mechanism for each type of coin, i.e. for every denomination in a monetary system. This makes the machine complex and expensive.

(b) When a denomination is missing from the supply in the machine, the machine stops. An arrangement of this type can only give change for a sum of money in one combination, determined by the logic of the machine.

The invention aims to avoid these disadvantages and provide an automatic device for dispensing a pre-determined sum of money, characterised in that the value of each of the demoninations, taken in decreasing order of value is subtracted as many times as possible from that sum, or from that sum less the value of the coins already returned; that each time subtraction is arithmetically possible and extracting mechanism is actuated to deliver a coin of the value subtracted, whereas when subtraction is arithmetically impossible or when a check on extraction shows that the coin of the value subtracted could not be delivered, the subtraction is cancelled and one goes on to subtract the value of the denomination below it, and possibly to extract coins of that denomination one after the other under the same conditions; and that the method is continued from coin to coin and from denomination to denomination until the result of the successive subtraction is zero.

The coin dispensing apparatus more particularly comprises a storage arrangement with at least one supply for each denomination of coins, the supplies being arranged parallel to one another, characterised in that it includes an arrangement for introducing numerical values; a unit which carries out successive subtractions, starting with the denomination of highest value, to define the number of times a coin of each denomination is required to form a sum which has to be returned; a mechanism for extracting the coins one after the other, controlled step by step by the unit; and a member for checking that each coin successively called for has actually been discharged; the checking member reacting on the unit, causing coins of lower denominations to be called for automatically, in the event of a coin which is called for not being delivered.

An embodiment of the coin dispensing arrangement according to the invention is illustrated diagrammatically and by way of example in the accompanying drawings, in which.

Figure 1:
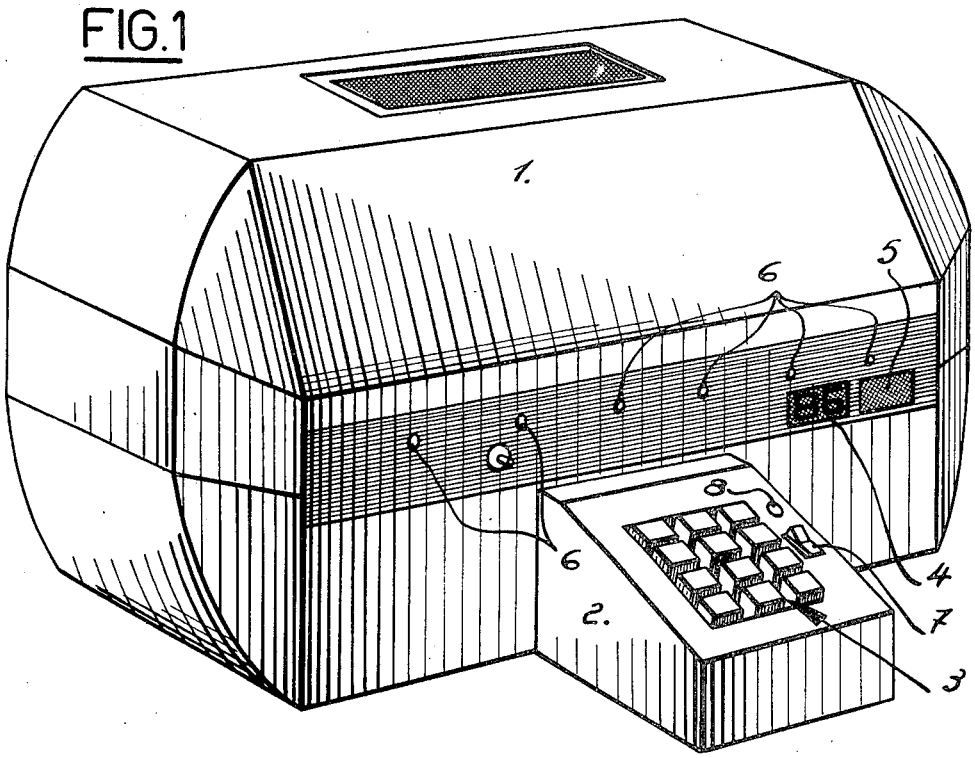
FIG. 1 is a perspective view of the coin dispenser from the rear.
Figure 2:
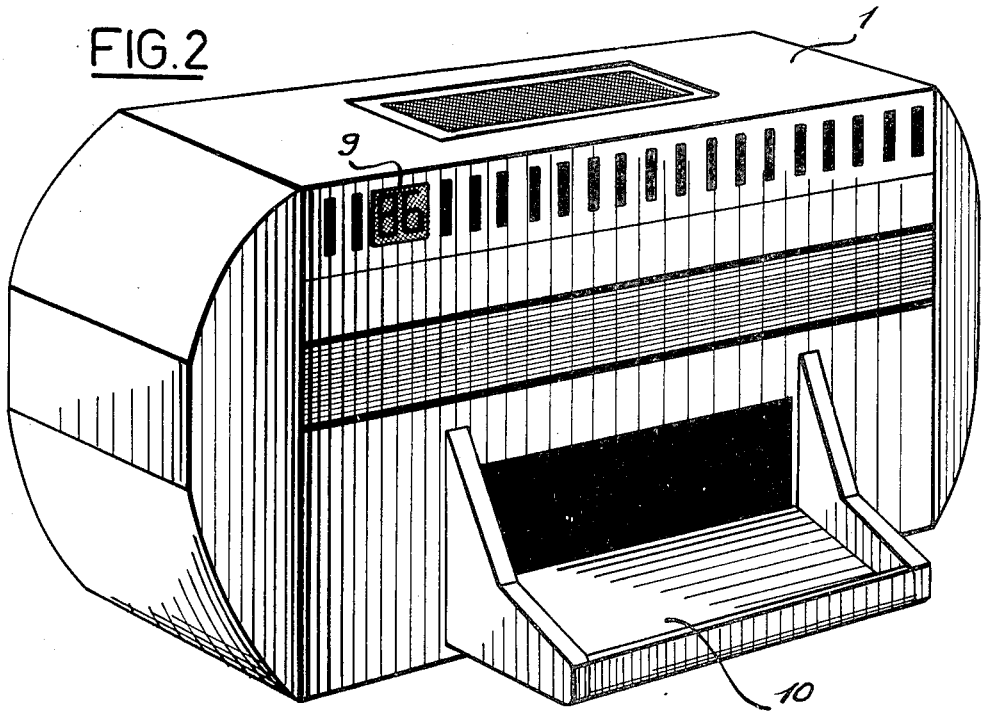
FIG. 2 is a perspective view of the coin dispenser from the front.
Figure 3:
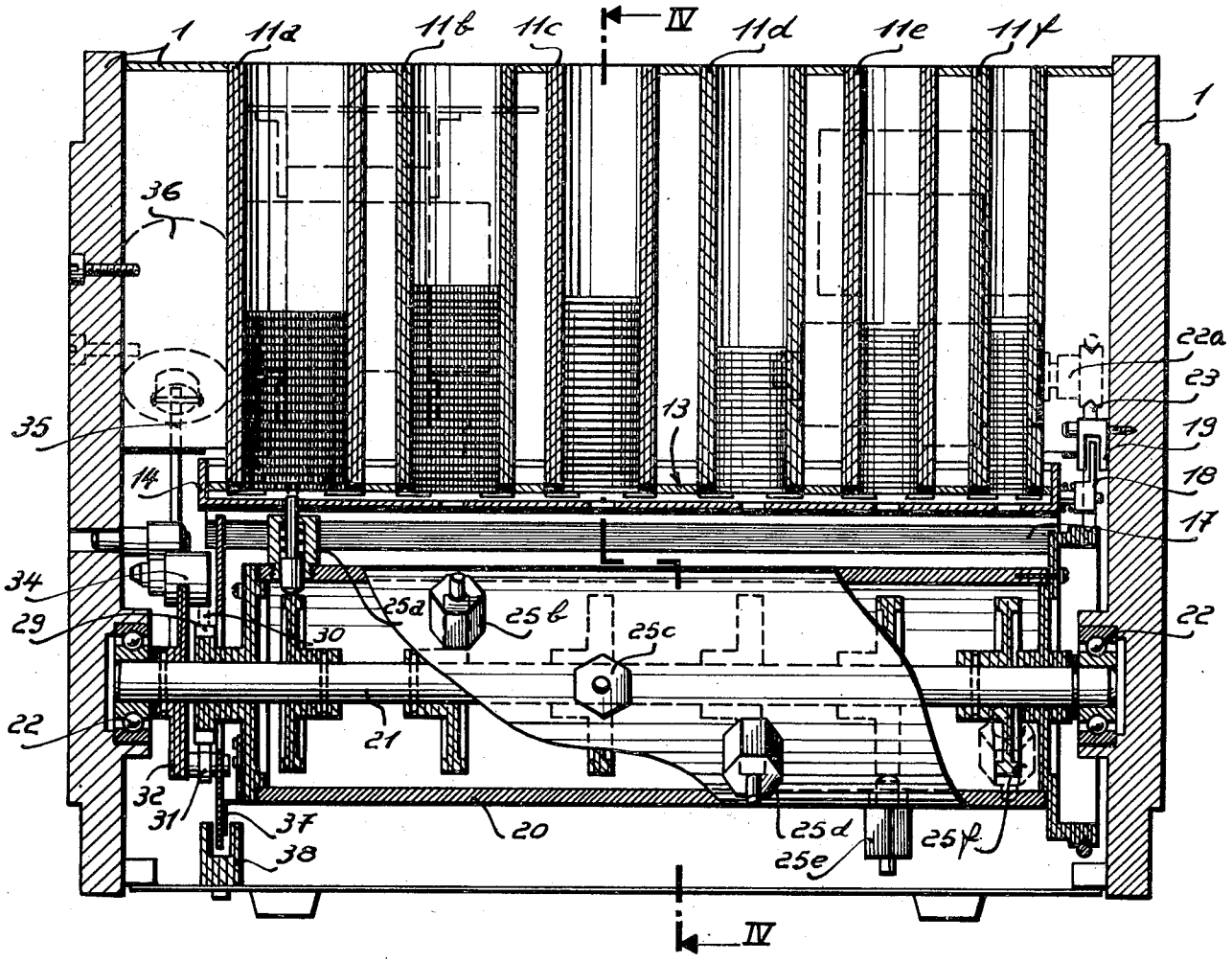
Figure 4:
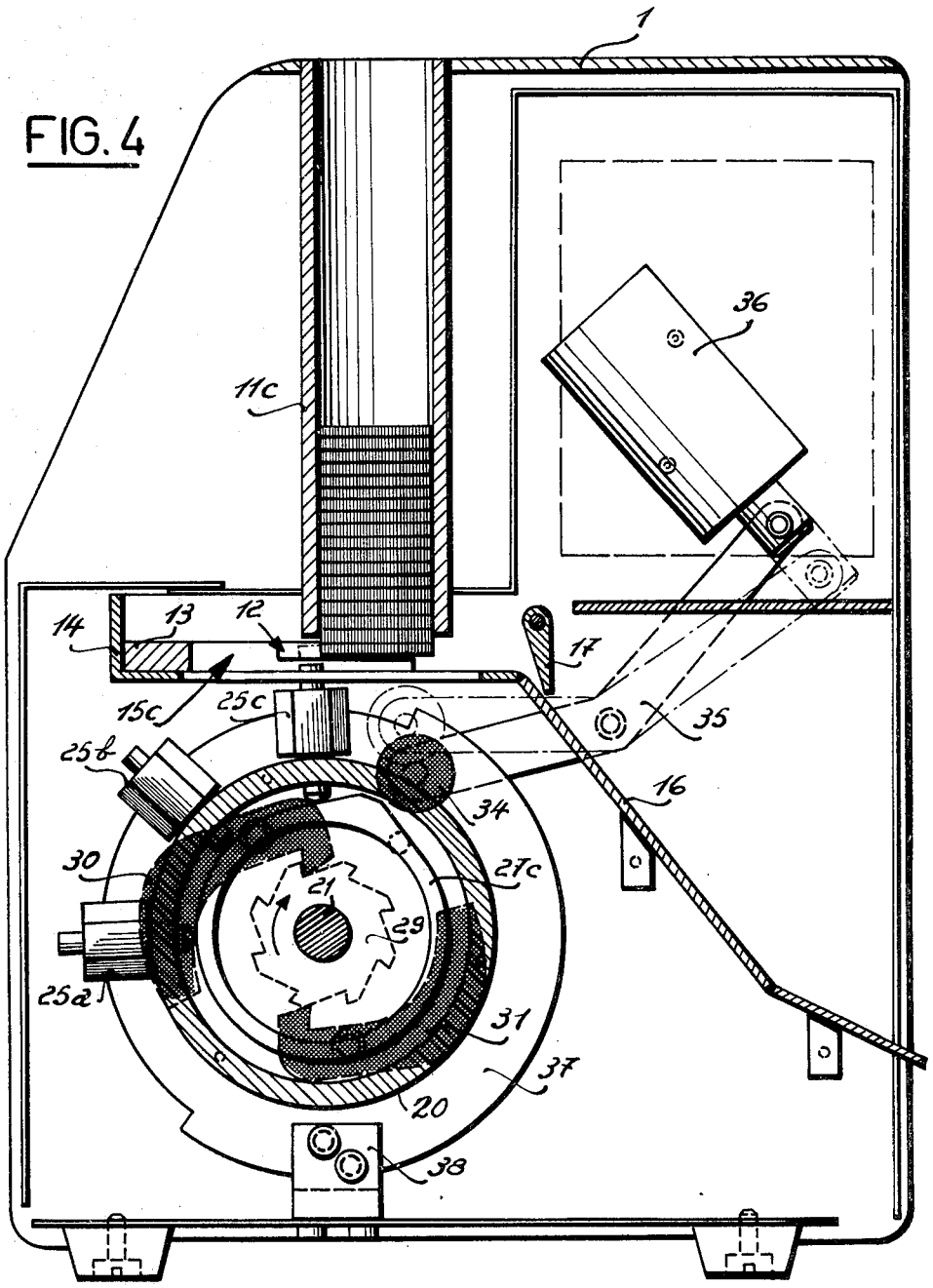
Figure 6:
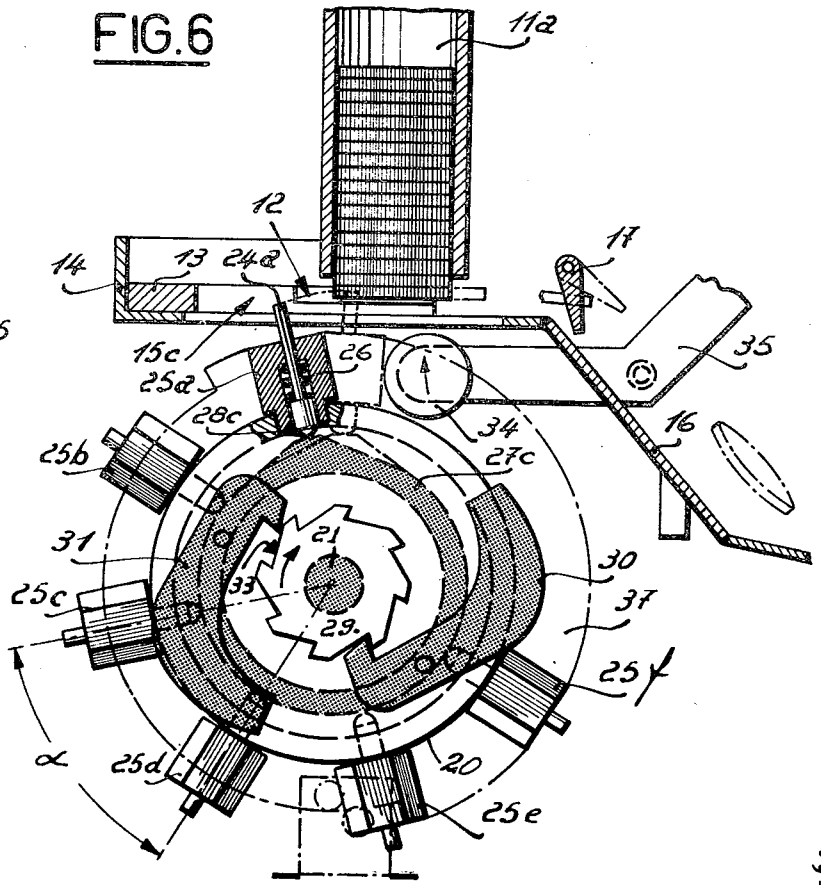
Figure 5:
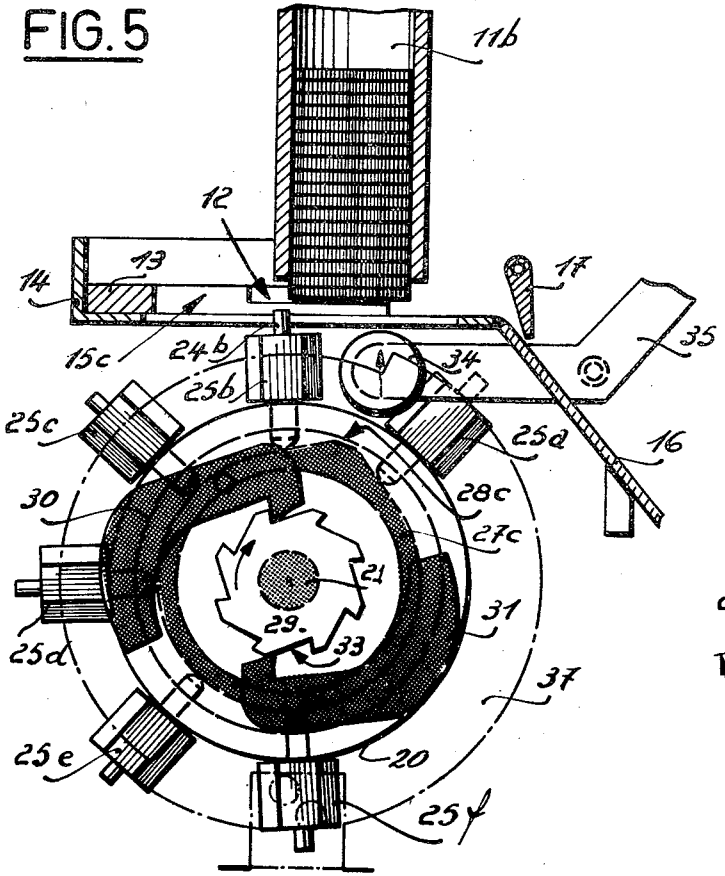
Figure 7:
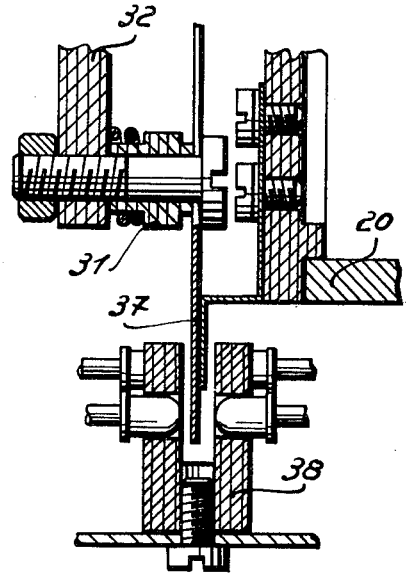
Figure 8:
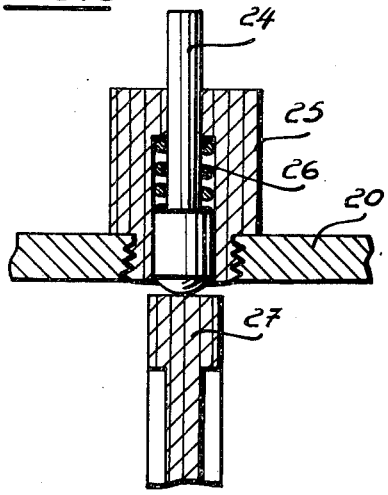
Figure 9:
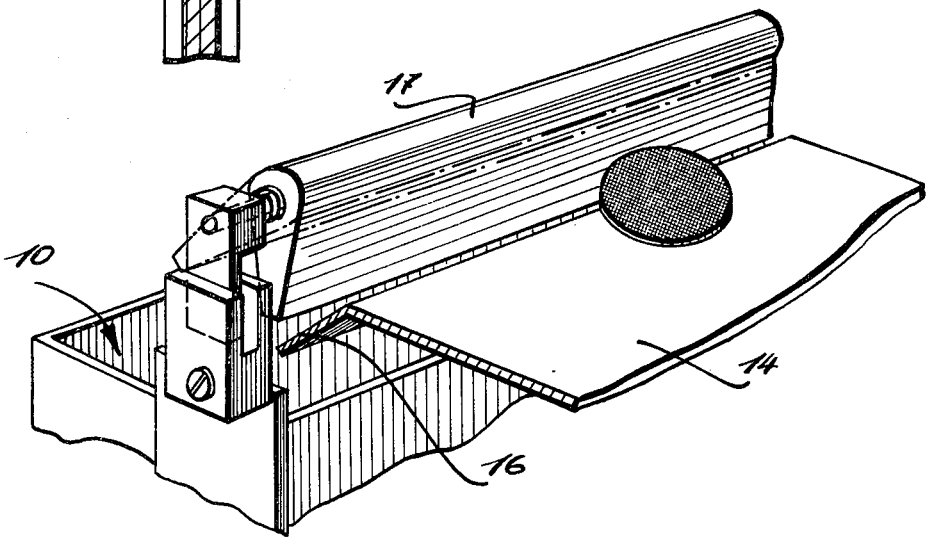
Figure 10:
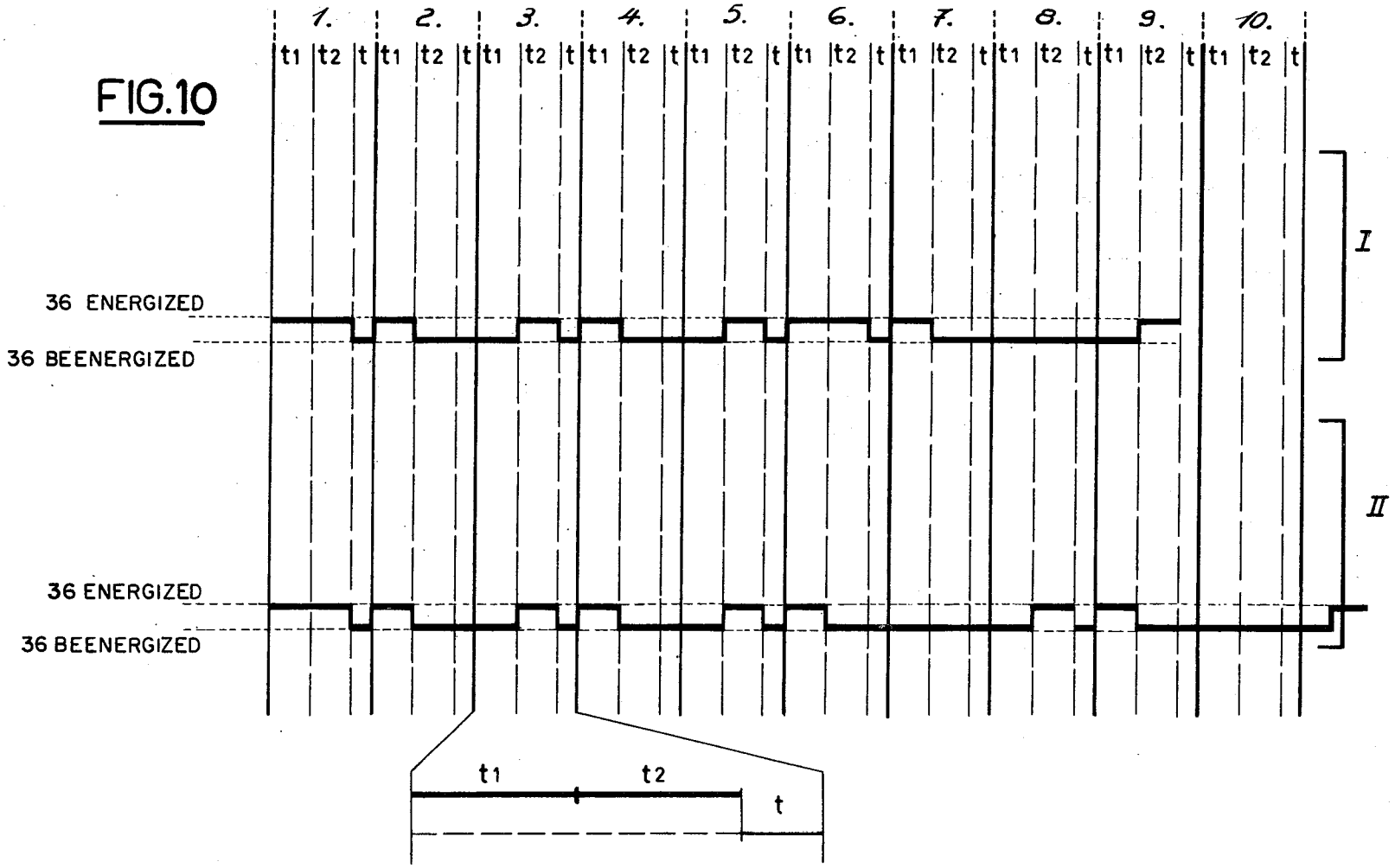

FIG. 3 is a partial longitudinal section with some parts of the coin dispenser broken away, FIG. 4 is a cross-section through the coin dispenser taken along the line IV–IV in FIG. 3, FIGS. 5 and 6 are partial cross-sections illustrating the coin ejecting mechanism, in its inoperative and operative position respectively, for a given denomination, FIG. 7 is a larger scale section through an arrangement for setting the angular position of the coin ejecting mechanism, FIG. 8 is a section through a detail of the coin ejecting peg, FIG. 9 is a perspective view of an arrangement for checking whether a coin has actually been dispensed, FIG. 10 contains two graphs showing the sequence of operations carried out to return a given sum of money in coins.

The coin dispensing machine illustrated has a conventional electronic portion (not shown) controlled by a small key-board with 10 keys for putting in the values. This electronic portion controls a coin dispensing mechanism by conventional electro-mechanical means. Finally, the coin dispenser comprises a supply of coins for each denomination, a means of displaying the sum to be returned, and a container to receive the coins returned.

The purely mechanical part of the coin dispenser will now be described with reference to FIGS. 1 to 9. The dispenser has a casing 1 containing the electronic part and the mechanisms. The rear face of the casing has a console 2 carrying a small 10-key key-board 3, so that the operator can feed the value of the sums to be returned, or representing the value of a purchase for example, into the logical computing unit of the dispenser. The rear face also has display means 4, 5 for visually displaying the sums put into the logical computing unit and/or the sum to be returned. It also has light signals 6 to indicate the lack of coins in the supply for any denomination. The console also carries a general on/off switch 7 and a light signal 8 to indicate that the dispenser is working. The rear face is the one which is turned towards the operator when the dispenser is in use.

The front face of the dispenser, the one turned towards the customer or the person to whom the change is being given, has a display 9 of the sum to be returned and a container 10 for the coins returned.

Casing 1 contains an arrangement for storing coins, classed by their denomination. In practice each denomination consists of one supply of coins, although in certain cases, where a denomination is used very frequently, there may be two supplies for the coins of that denomination.

In the example illustrated the storing arrangement comprises six supplies 11*a*, 11*b*, 11*c*, 11*d*, 11*e*, 11*f* of different denominations, each consisting of a tube open at both ends and fixed approximately vertically in casing 1. The aperture at the top of each tube enables the supply to be replenished with coins of the appropriate denomination. The internal diameter of the tubes obviously corresponds to the external diameter of the coins of the denomination in question.

The lower end of each tube 11 is located near a supporting surface 12, at a distance slightly greater than the thickness of the coins destined for the tube in question. Supporting surface 12 forms part of a component 13, which is fixed to the casing of the dispenser by a metal plate 14. Surface 12 and part of component 13 and plate 14 are slotted approximately along an extension of the axis of supplies 11 and across the dispenser, so as to form passages 15*a* to 15*f* designed to give passage to the ejecting pegs of the dispensing mechanism.

The front end of plate 14 is welded to the upper part of an inclined plane 16, which is fixed to the casing and guides the ejected coins into a container 10 by gravity. An oscillating shutter 17 located in the path of the ejected coins actuates a shutter 18 of an optical detector 19 as each coin passes. A signal of acknowledgment is thus given each time a coin has actually been dispensed. It should be noted that a single shutter 17, covering the whole range of supplies 11*a* to 11*f*, is sufficient for this control, since the coins are always delivered in succession. FIG. 9 illustrates a detail of the control arrangement.

The coin ejecting mechanism, with successive ejection, essentially comprises a rotating cylinder 20 pivoted loosely on a shaft 21, which is itself mounted loosely on the casing of the dispenser by ball bearings 22*a*. Cylinder 20 is rotated by a motor 22 with the aid of a belt 23. The rotation of cylinder 20 is continuous and at constant speed for the whole period of operation of the dispenser.

Ejecting pegs 24*a*, 24*b*, 24*c*, 24*d*, 24*e*, 24*f* are mounted at the periphery of cylinder 20. They are arranged in a helical line, since each peg 24 is located in a plane containing the axis of the appropriate coin supply 11, and since the pegs 24 are offset at an angle from one another. Generally, pegs 24 are offset at an angle $\alpha$ such that they are uniformly distributed around the axis of cylinder 20. Each peg 24 is mounted for sliding movement in a support 25 and acted on by a return spring 26, which tends to hold it in a retracted position. In this position it projects little or not at all from support 25 and does not interfere with the coin at the bottom of the appropriate supply 11 when passing below the latter. A stop (not shown) determines the retracted position of peg 24. As will be seen later, each peg 24 can be placed in the operative position against the action of its return spring 26. For the active position peg 24 is moved radially out of cylinder 20, far enough for it to enter the appropriate passage 15 in the course of its rotation, and to carry along the last coin in supply 11, causing it to be ejected onto inclined plane 16.

The position of the pegs is controlled by cams 27*a* to 27*f*, which are fixed on shaft 21 and arranged in the same plane as their associated peg. Each cam 27 has a lifter 28, designed to interact with the inner end of the corresponding peg 24. The angular size of the lifter is less than the angle $\alpha$ by which two adjacent pegs 24 are offset from one another, and generally equal to half the angle $\alpha$ or less.

All the cams 27 are fixed rigidly to shaft 21 and positioned with their lifters 28 in angular alignment.

Cam shaft 21 with the cams 27 which it carries is located inside cylinder 20. The end of cylinder 20 carries a ratchet wheel 29 with a number of teeth equal to the number of pegs 24 and thus of coin supplies 11. The ratchet wheel interacts alternately with two catches 30, 31 which are connected to a disc 32 fixed rigidly to shaft 21. The joint pins for catches 30, 31 are shaped and located so that the catches are brought automatically into engagement with ratchet wheel 29 by the effect of the rotation. Catches 30, 31 are not exactly diametrically opposed, but rather offset from one another by an angle corresponding to half the angle $\alpha$, or half a tooth of the ratchet wheel, relative to a cylinder diameter. Thus when cylinder 20 is rotated only one of the teeth on the ratchet wheel interacts with a catch (30). The other catch is applied by centrifugel force to the inclined surface 33 of one of the opposed teeth of the ratchet wheel. This coupling between cylinder 20 and shaft 21 in fact constitutes an escapement. By deliberately rocking catch 30 (FIG. 5), it can be released from ratchet wheel 29, momentarily disconnecting shaft 31 from cyliner 20. Cylinder 20 is offset by half a pitch ($\alpha/2$) from shaft 21, and from that moment catch 31 is in engagement with a tooth on ratchet wheel 29 and shaft 21 is again driven synchronously with cylinder 20. By acting successively on catches 30 and 31 one can offset cams 27, which are rigidly connected to shaft 21, half pitch by half pitch from cylinder 20. One half pitch in two every lifter 28 of cams 27 is offset angularly from its associated peg 24, while for the intermediate half pitches a cam 27, each time a different one, actuates its associated peg 24 to place it in the operative position.

Thus, in the example illustrated, of the twelve useful relative positions (i.e. equal to twice the number of supplies 11) that cylinder 20 can assume relative to shaft 21, six positions correspond to states where no peg 24 is placed in an operative position and six others, interposed between the previous ones, correspond to states where one of the six pegs 27 is each time placed in an operative position.

When the whole of this mechanism rotates, the outer part of each catch 30, 31 passes once per revolution opposite a control roller 34, designed to interact with the catches when it is in the operative position. Control roller 34 is pivoted on the end of a lever 35, which is connected to casing 1 and actuated by an electro-magnet 36, controlled by the electronic part of the coin dispenser.

Cylinder 20 rotates a disc 37 which interacts with an optical detector 38 to determine the original angular position of cylinder 20 relative to casing 1.

Key-board 3 enables the data, particularly the value of the sum to be dispensed, to be fed into a conventional counting/deducting register which transmits a signal to a conventional detector which determines whether the signal is positive or negative and transmits this information to a logical time control unit which receives information from detector 38 on the positioning of cylinder 20 ($t_1$, $t_2$) and from detector 19 as to whether a coin has been delivered or not. The logical time control supplies a conventional amplifier 42 for controlling electro-magnet 36, and a conventional off-setting register. Control 41 also positions register 39 for counting or deducting. Off-setting register which controls a conventional pulse generator in accordance with the programme corresponding to the values of decreasing denominations. The circuitry of the register and detector and logical time control unit are all conventional and can for example be as disclosed in U.S. Pat. Nos. 3,682,183 or 3,756,256. The detection of whether a coin has actually been discharged can be as in U.S. Pat. No. 3,958,583; while circuitry for skipping a denomination that cannot be dispensed can be as in U.S. Pat. No. 3,963,035. These features form no part of the present invention as such.

The control pulses transmitted to electro-magnet 36 are shorter than the time taken for cylinder 20 to make half a revolution. Each pulse at electro-magnet 36 thus causes cam-shaft 21 to be offset angularly by half a pitch from cylinder 20, as mentioned above.

To give a better understanding of how the cash dispenser works, two modes of operation, which can be carried out by the machine to return the same sum of money, will now be described with reference to the diagrams in FIG. 10.

The following meanings will first be defined to clarify these examples:

$t_1$ = space of time during which electro-magnet 36 is energised to act on catch 30, causing it to place shaft 21 in a = position, relative to cylinder 20, such that a peg 27 is placed in the operative position.

$t_2$ = space of time during which electro-magnet 36 is energised to act on catch 31, causing it to place shaft 21 in a position, relative to cylinder 20, such that no peg 27 is in the operative position (intermediate or rest position of ejecting mechanism).

T = effective time of operation, during which the peg put into the operative position causes a coin to be ejected or dispensed.

It should be noted that the sum $t_1 + t_2 + T$ is equal to a complete revolution of cylinder 20 on itself.

It will also be assumed that at the beginning of the operation shaft 21 occupies a position, relative to cylinder 20, such that the mechanism is in the intermediate or rest position, half a pitch before peg 27*a*, corresponding to the supply 11*a* of coins of the highest denomination, is put into the operative position.

EXAMPLE 1

Using the five coins of U.S.A. currency (50*c*; 25*c*; 10*c*; 5*c*; and 1 *c*), 37 cents have to be returned.

In this first case coins of all denominations will be taken to be available in the required quantity.

In order to return 37 cents in this case, the machine will have to deliver no 50 cent coins, one 25 cent coin, one 10 cent coin, no five cent coins, and two one cent coins.

For this example the operations of the dispenser are illustrated in the upper part 1 of FIG. 10.

1. During the first revolution of cylinder 20, 50 cents is subtracted from 37 cents and a negative result is obtained. This causes the 50 cents to be added on, giving 37 cents again. Electro-magnet 36 is energised for a time $t_1 + t_2$, causing the two catches 30 and 31 to be actuated, and thus causing peg 27*a* to pass into the operative position (during part of the revolution of cylinder 20 when peg 27*a* is opposite coin supply 11*a*) then to pass into the succeeding intermediate or rest position. During working time T peg 27*a* is consequently again in the retracted position and no coin from supply 11*a* is delivered.

2. During the second revolution of cylinder 20, 25 cents is subtracted from 37 cents giving a positive result, 12 cents. The electro-magnet is energised, this time only for a time $t_1$, causing peg 27*b* to be put in the operative position. During the working time, since peg 27*b* has not been returned to the position of rest, it passes below coin supply 11*b* and causes the last 25 cent coin to be carried along and dispensed.

3. During the third revolution of cylinder 20, acknowledgment is given of the dispensing of the 25 cent coin. An attempt is made to subtract another 25 cents but a negative result is obtained. Consequently the 25 cents is added on again, bringing a return to the previous result of 12 cents. This also indicates that no more 25 cent coins should be delivered, and electro-magnet 36 is energised for a time $t_2$, thus placing the extracting mechanism in its succeeding intermediate position. No coin is therefore dispensed during working time T.

4. During the fourth revolution of cylinder 20, 10 cents is subtracted from the previous result, i.e. 12 cents, giving a positive result and thus an indication that a coin of that value should be dispensed. Electro-magnet 36 is energised only for a time $t_1$, causing shaft 21 to be offset half a pitch from cylinder 20, and thus causing the peg 27*c* corresponding to the supply of 10 cent coins 11*c* to be put in the operative position. During working time T peg 27*c* carries a coin out of supply 11*c* and dispenses it onto inclined plane 16 and thus into container 10 where it is added to the 25 cent coin already dispensed during the second revolution of cylinder 20.

5. During the fifth revolution of cylinder 20, acknowledgment for the last coin is given and an attempt is made to subtract another 10 cents from the preceding result, i.e. 2 cents. The result is negative, so 10 cents is added on and the previous result obtained, i.e. 2 cents. Consequently electro-magnet 36 is energised only for time $t_2$, thus placing the extracting mechanism in its succeeding intermediate position, so that no coin is dispensed during working time T.

6. During the sixth revolution of cylinder 20, a negative result having previously been obtained, an attempt is made to subtract from the remainder (2 cents) the value of the following denomination (5 cents). This gives a negative result, leading to the re-addition of 5 cents and a return to the previous result. This situation causes electro-magnet 36 to be energised for the space of time $t_1 + t_2$ and thus causing shaft 21 to be offset two half pitches from cylinder 20. Under these circumstances the extracting mechanism passes directly to its succeeding intermediate position, and no coin is delivered during this sixth revolution of cylinder 20.

7. During the seventh revolution of cylinder 20, an attempt is made to subtract the value of the following denomination (1 cent) from the previous result, which was 2 cents. The result is positive. Electro-magnet 36 is energised for a time $t_1$ only, and peg 27*e* corresponding to the supply 11*e* of 1 cent coins is put into the operative position. A 1 cent coin is delivered during working time T.

8. During the eighth revolution of cylinder 20, an attempt is made to subtract 1 cent again from the previous result, after acknowledgment has been obtained for the delivery of the previous coin. This gives a result of zero, so a coin has to be delivered and the machine then stopped. Since peg 27*e* is already in the operative position, the electro-magnet is not energised at all. Peg 27*e* remains in the operative position and delivers a second 1 cent coin. After the discharge of the coin has been acknowledged, during the ninth revolution of cylinder 20, the electro-magnet is energised for a time $t_2$, thus replacing the extracting mechanism in its initial position of rest. The number of half pitches of the extracting mechanism required to carry out a complete cycle, or a complete revolution of shaft 21 relative to cylinder 20, is in fact always equal to twice the number of extracting pegs, and this is generally equal to the number of denominations or of different coins. In the present case one would have five pegs, one for each denomination of American currency, and thus ten half pitches to cross in order to complete a cycle.

As logical computing operations take place very rapidly or almost instantaneously, cylinder 20 can be rotated rapidly, e.g. at one to ten revolutions per second, and a sum of money can be dispensed very rapidly, even if this involves ten revolutions of the cylinder; in practice it only takes a few seconds.

EXAMPLE 2

In this example the sum of 37 cents again has to be dispensed, but this time it is assumed that the supply of 10 cent coins is exhausted. It will be seen that this does not prevent the change from being given.

In this case the machine will have to deliver no 50 cent coins, one 25 cent coin, no 10 cent coins since there are none in the corresponding supply, two 5 cent coins and two 1 cent coins.

The example is illustrated in the lower part 11 of FIG. 12.

1 to 4. In this example the procedure is the same as in Example 1 to the end of the fourth revolution of cylinder 20. That is to say, the machine again has to deliver no 50 cent coin, one 25 cent coin but not a second 25 cent coin. It then determines that a 10 cent coin has to be delivered, but since the supply 11*c* of 10 cent coins is exhausted, despite the fact that peg 27*c* is in the operative position the 10 cent coin is not delivered.

5. During the 5th revolution of cylinder 20, no acknowledgment of the discharge of the 10 cent coin is received. The 10 cents is therefore added on again to give the old result of 12 cents. This causes electro-magnet 36 to be energised for a time $t_2$ and the extracting mechanism to move into its succeeding inoperative position. No coin is delivered during the working time.

6. During the sixth revolution of cylinder 20 an attempt is made to subtract the value of the following denomination, 5 cents. A positive result is obtained, 7 cents, and the electro-magnet is therefore energised only for a time $t_1$ to put peg 27*d* into the operative position. A 5 cent coin is delivered during working time T.

7. During the seventh revolution of cylinder 20, an attempt is made to subtract another 5 cents, and a positive result is again obtained, i.e. 2 cents. Since peg 27*d* corresponding to the supply 11*d* of 5 cent coins is still in the operative position, the electro-magnet is not energised, and a second 5 cent coin is delivered during the working time.

8. During the eighth revolution of cylinder 20, acknowledgment of the discharge of the 5 cent coin is received. A third attempt is made to subtract 5 cents but a negative result is obtained, and the 5 cents is added on to the previous result of 2 cents. Electro-magnet 36 is energised for a time $t_2$, thus placing the extracting mechanism in its next inoperative position. No coin is delivered during the working time.

9. During the ninth revolution of cylinder 20, an attempt is made to subtract the value of the next denomination, i.e. 1 cent, and a positive result is obtained. The electro-magnet is therefore energised only for a time $t_1$, causing peg 27*e* corresponding to the supply 11*e* of 1 cent coins to be moved into the operative position. During the working time a one cent coin is delivered. The dispensing operation is then concluded during the tenth and eleventh revolutions of the cylinder, as it was during the eighth and ninth revolutions of the cylinder in Example 1. A second 1 cent piece is thus dispensed and the machine is stopped.

The advantage illustrated by this second example, that a given sum can be delivered even if one of the denominations is missing from the storage arrangement in the dispenser, is directly due to the idea of the sequential distributing process.

Another advantage derived from the sequential nature of the process is the simplicity of the extracting mechanism, controlled by one electro-magnet. This is made possible by the fact that the coins are delivered in succession, rather than simultaneously as in existing machines.

Obviously many alternative embodiments can be envisaged, particularly for the various apparatuses and mechanisms in the dispensers, without going beyond the scope of the protection claimed. In particular, two supplies of the same denomination may be provided if the denomination is used very frequently; this would naturally involve an appropriate change in the programme of the dispenser.

It should be noted that as a general rule the extracting mechanism has as many pegs as there are supplies of coins. However, with a view to rationalising its manufacture, the extracting arrangement may have more pegs than coin supplies. In this case a certain number of steps will be omitted or passed through rapidly at the end of the cycle, during the complete cycle of the change-giving process.

The description just given of the arrangement was given purely as a non-restrictive example. Various modifications can of course be made to it by experts without going beyond the scope of the invention.

We claim:

1. A coin dispenser comprising a plurality of upright coin chutes for containing a plurality of different denominations of coins in stacks disposed side-by-side, a horizontal cylinder disposed beneath the stacks, means for continuously rotating the cylinder, a plurality of pegs having radially extending inner and outer ends and mounted on the cylinder for radial movement relative to the cylinder, said pegs being disposed in a helical arrangement about the periphery of the cylinder with one peg disposed beneath each stack and the pegs spaced from each other both parallel to the axis of the cylinder and angularly about the periphery of the cylinder, and means for selectively individually moving said pegs radially outwardly relative to the cylinder when a said peg is disposed beneath the stack of coins of which one is to be dispensed, whereby the outer end of the selectively extended peg contacts the edge of the lowermost coin in the stack and dispenses that contacted coin from the stack.

2. A dispenser as claimed in claim 1, said moving means comprising a cam shaft coaxial with the cylinder and selectively rotatable relative to the cylinder and disposed within the cylinder, said cam shaft having cams thereon engageable with the inner ends of said pegs upon rotation of said cam shaft and cylinder relative to each other, and means for selectively rotating said cam shaft relative to said cylinder.

3. A dispenser as claimed in claim 2, said cams being equal in number to said pegs and in alignment with each other in a direction parallel to said cam shaft.

4. A dispenser as claimed in claim 2, said means for rotating said cam shaft comprising a ratchet fixed to said cylinder and at least one pawl rotatable with said cam shaft and selectively engageable with said ratchet.

5. A dispenser as claimed in claim 4, said ratchet having as many teeth thereon as the number of said pegs.

6. A dispenser as claimed in claim 4, there being two said pawls on opposite sides of said ratchet which are diametrically opposed but offset by one pitch of said ratchet so that only one said pawl at a time is in engagement with a tooth on said ratchet.

* * * * *